United States Patent [19]

O'Blasny

[11] 4,439,311

[45] Mar. 27, 1984

[54] REREFINING USED LUBRICATING OIL WITH HYDRIDE REDUCING AGENTS

[75] Inventor: Richard H. O'Blasny, Natchitoches, La.

[73] Assignee: Delta Central Refining, Inc., Natchitoches, La.

[21] Appl. No.: 336,900

[22] Filed: Jan. 4, 1982

[51] Int. Cl.[3] ..... C10G 7/10; C10G 7/00; C10M 11/00

[52] U.S. Cl. ..... 208/179; 208/184; 208/348; 208/251 R

[58] Field of Search ..... 208/179, 184, 348, 251 R

[56] References Cited

U.S. PATENT DOCUMENTS

| | | | |
|---|---|---|---|
| 3,008,897 | 11/1961 | Burk, Jr. et al. | 208/251 R |
| 3,425,933 | 2/1969 | Lester | 208/251 R |
| 3,639,229 | 2/1972 | Brownamell et al. | 208/184 |
| 3,879,282 | 4/1975 | Johnson | 208/251 R |
| 3,919,076 | 11/1975 | Cutler et al. | 208/184 |
| 4,021,333 | 5/1977 | Habiby et al. | 208/181 |
| 4,252,637 | 2/1981 | Knorre et al. | 208/184 |
| 4,366,049 | 12/1982 | Knorre et al. | 208/179 |

FOREIGN PATENT DOCUMENTS

| | | | |
|---|---|---|---|
| 243666 | 10/1926 | United Kingdom | 208/179 |
| 327721 | 4/1930 | United Kingdom | 208/179 |
| 1526334 | 9/1978 | United Kingdom | 208/179 |

OTHER PUBLICATIONS

Product Improvement With Sodium Borohydride by Ventron Corporation.

*Primary Examiner*—Delbert E. Gantz
*Assistant Examiner*—Helane E. Maull
*Attorney, Agent, or Firm*—Winburn & Gray, Ltd.

[57] ABSTRACT

Used lubricating oil is rerefined utilizing hydride reducing agents. The hydride reducing agent contacts the used oil in an aqueous solution, for example. Contact with the hydride reducing agent may occur before, during or after distillation or evaporation of the used lubricating oil. The disclosed method reduces the concentration of carbonyl compounds and metals and reduces the corrosion characteristics of used lubricating oil.

17 Claims, No Drawings

REREFINING USED LUBRICATING OIL WITH HYDRIDE REDUCING AGENTS

BACKGROUND OF THE INVENTION

Waste oils have generally been disposed of by incineration, in landfill, or used in road oiling for dust control, because the cost of reclamation and rerefining has been excessive. However, because of the rising cost of hydrocarbon fuels and lubricants, coupled with the ever-increasing demand and depletion of resources, the need for an efficient, low-cost waste oil rerefining process has arisen.

Large and increasing volumes of used lubricating oil, particularly crankcase oils from diesel and internal combustion engines are produced each year. These waste oils are contaminated with oxidation and degradation products, water, fine particulates, metal and carbon and oil additive products and other contaminants not found in virgin crude oil. Many of these contaminants are formed from the degradation of the lubricating oil when used in engines or are contaminants from use which become added to the oil. These contaminants render the oils unsuitable for continued use. Thus, the considerations and problems in connection with rerefining used lubricating oil are different from those associated with the refining of virgin crude oil, since used oil contains contaminants not present in crude oil.

In recent years some small scale rerefining processes have been put into operation in which marketable oils are recovered. However, due to the high costs involved and the resulting narrow margin of profit, such recovery processes represent small percentage utilization of the total quantity of used lubricating oils.

The ever-increasing scarcity and consequent high costs of petroleum, particularly high quality lubricating stocks, now presents positive incentives to selectively remove undersirable contaminants from used motor oils and reuse the valuable high quality lubricating components contained in such oils.

Several waste oil rerefining processes are known from the prior art. For example, in U.S. Pat. No. 3,639,229, a process is described where a mixture of an aliphatic monohydric alcohol of from four to five carbon atoms and a light hydrocarbon is added to waste oil. The mixture settles into three distinct layers. The upper oily layer is recovered, treated with sulfuric acid and thereafter refined by conventional means.

In U.S. Pat. No. 3,919,076, a process is described that involves removing water from the waste oil, adding a saturated hydrocarbon solvent, settling the mixture to recover the oil/solvent mix, removing the solvent, vacuum distilling the residual oil to collect selected fractions, hydrogenating the fractions over a catalyst, stripping hydrogenated oil to remove light ends and filtering the remaining product.

U.S. Pat. No. 4,124,492 discloses a process for reclaiming useful hydrocarbon oil from contaminated waste oil in which the waste oil is dehydrated and, thereafter, the dehydrated oil is dissolved in selected amounts of isopropanol. The undissolved waste matter is separated and the residual oil/solvent fraction is distilled to recover the decontaminated oil and solvent. The recovered oil is further clarified by treatment with a bleaching clay or activated carbon at elevated temperatures.

In U.S. Pat. No. 4,021,333, a process is described for rerefining used oil that includes distilling a volatile forecut from the oil, followed by a conventional type of distillation that may occur at reduced pressure. Use of demister means is preferred to minimize carry-over of material into the distillate. The distillation is continued until the desired recovery is obtained. The impurities present in the distillate are extracted.

A need exists for a method of effectively removing or otherwise eliminating undesirable contaminants found in used lubricating oil to make the rerefined oil more suitable for use in, for example, internal combustion engines. Further, a need exists for such a method that is feasible for use on a commercial scale.

DISCLOSURE OF THE INVENTION

In accordance with the present invention, a method is provided for rerefining used oil containing lubricating oil. The method in accordance with the present invention reduces the concentration of metals, carbonyl compounds and other contaminants which are present in the oil from lubricating use, such as use in internal combustion engines and the like, for example. In addition, the method reduces the corrosion characteristics of the lubricating oil, thereby making the oil more suitable for reuse. Further, the color, odor, oxidation stability and thermal stability of the oil are improved. When combined with distillation or evaporation purification of the used oil, the distillation or evaporation curve is lowered, thereby providing a greater amount of overhead product at a given temperature. Thus, more of the used oil can be recovered without resorting to higher temperatures, resulting in an energy savings and helping to avoid coking and cracking of the oil and fouling of equipment. Other advantages include a treated used lubricating oil having a lower neutralization number and a higher flash point.

Thus, in one aspect, the present invention relates to increasing the yield of recovered lubricating oil without subjecting the waste oil feedstock in temperatures that create conditions of coking, cracking, or fouling. In another aspect, this invention relates to a process for reducing the concentration of metals and carbonyl compounds present in used lubricating oil, while reducing the corrosion characteristics of the used lubricating oil, improving color, odor, neutralization number, oxidation stability and thermal stability. Still another aspect of this invention relates to reducing the distillation or evaporation temperature while achieving the desired recovery of lubricating oil from the waste oil feedstock.

In accordance with the present invention, a method of reducing the concentration of metals, carbonyl compounds and other contaminants present in the used oil from use, reducing corrosion characteristics of the used lubricating oil and improving other characteristics of the oil, includes contacting the used lubricating oil with at least one hydride reducing agent. Contact is maintained for a sufficient time to cause reaction and/or removal of contaminants from the oil.

The used lubricating oil may be maintained at an elevated temperature during contact with the hydride reducing agent, the elevated temperature being below the decomposition temperature of the hydride reducing agent. The preferred hydride reducing agent is selected from the group consisting of sodium borohydride, potassium borohydride and mixtures thereof.

The method of the present invention generally is used as part of a process for rerefining used lubricating oil which may include distillation or evaporation of the used lubricating oil either before, during and/or after contact with the hydride reducing agent. Thus, the hydride reducing agent may be added to a distillation column, for example, separately or mixed with the used lubricating oil that is fed to the distillation column. Unreacted hydride reducing agent and other unwanted materials exit the distillation column as bottoms. In one embodiment, the hydride reducing agent is present in an aqueous solution with sodium hydroxide and, when fed to a distillation column or evaporation unit, reduces the viscosity of the bottoms while reducing the temperature required to obtain a desired recovery of lubricating oil from the overhead fraction or fractions.

The present invention may be utilized either as a batch, semi-continuous or continuous process.

Care should be selected in the choosing of a particular hydride reducing agent since some hydride reducing agents are very unstable at elevated temperatures or slightly elevated temperatures and thus could pose a serious safety hazard if special precautions are not taken.

DETAILED DESCRIPTION

In accordance with the invention, the used lubricating oil is contacted with at least one hydride reducing agent. It is to be understood that by "contacting," included is any method by which the hydride reducing agent contacts the used lubricating oil and the contaminants contained therein. Contact between the oil (including contaminants) and the hydride reducing agent can be achieved by adding the hydride directly to the used lubricating oil feedstock before any other treatment is begun. The used oil may be advantageously maintained at elevated temperature (greater than ambient temperature) during contact with the hydride reducing agent because the rate of reaction between the hydride reducing agent and contaminants increases as the temperature increases. However, the temperature should be lower than the decomposition temperature of the hydride reducing agent. Accordingly, heating may be utilized to attain a desired temperature. Further, some type of agitation or mixing is desirable to further increase the rate of reaction. Preferably, the hydride reducing agent is present in an aqueous solution with sodium hydroxide. The aqueous solution is contacted with the used lubricating oil and an oil phase and an aqueous phase forms. The aqueous phase, containing removed impurities and reaction products formed by contact between the used oil and hydride reducing agent, is separated from the oil phase.

Most advantageously, the hydride reducing agent is used in combination with a process for rerefining used oil either by evaporation or distillation in which the hydride reducing agent is utilized to remove contaminants, including metal and carbonyl contaminants, from the used oil. In this embodiment, the hydride reducing agent is preferably added to a distillation column or an evaporation unit as an aqueous solution with sodium hydroxide. This has the effect of reducing the distillation or evaporation temperature of the used lubricating oil and further provides a bottoms or residue product that is more fluid, facilitating pumping or other transport of the bottoms.

The distillation or evaporation should occur at a temperature lower than the decomposition temperature of the hydride reducing agent utilized, to thereby prevent decomposition of the hydride reducing agent.

Suitable evaporation processes are disclosed in U.S. Pat. No. 4,342,645, issued Aug. 3, 1982 to Laird C. Fletcher and Harold J. Beard, and U.S. Pat. No. 4,360,420, issued Nov. 23, 1982 to Laird C. Fletcher, Harold J. Beard and Richard O'Blasny, and entitled, respectively, "Method of Rerefining Used Lubricating Oil" and "Distillation and Solvent Extraction Process for Rerefining Used Lubricating Oil." It is to be understood that use of the present invention is not limited to use with evaporation, distillation or with the processes disclosed in the foregoing applications. Other processes may be used advantageously in conjunction with or as a modification of the invention. Processes which may be suitable are found in a book entitled "Reprocessing and Disposal of Waste Petroleum Oils" by L. Y. Hess published by Noyes Data Corporation.

Hydride reducing agents that are suitable for use in accordance with the invention include the following compounds: sodium borohydride ($NaBH_4$); potassium borohydride ($KBH_4$); zinc borohydride ($Zn(BH_4)_2$); sodium cyanoborohydride ($NaBH_3CN$); sodium sulfurated borohydride ($NaBH_2S_3$); lithium organo borohydride ($LiBH(R)_3$); sodium trioxyacetal borohydride ($NaBH(OAc)_3$); sodium trialkoxy borohydride ($NaBH(OR)_3$); sodium hydroxyl borohydride ($NaBH_3(OH)$); sodium borohydride anilide ($NaBH_3$(anilide)); tetrahydrofuran borohydride ($THF.BH_3$); di-methyl-butyl borohydride ($(3\text{-Me-2-Bu})_2BH$); lithium-aluminum hydride ($LiAlH_4$); lithium-aluminum tri-oxymethyl hydride ($LiAlH(OMe)_3$); sodium-aluminum-2-methoxyethoxy hydride ($NaAlH_2(OC_2H_4OCH_3)_2$) and aluminum hydride ($AlH_3$). Mixtures of the foregoing hydrides can also be utilized. However, in choosing among these various hydride reducing agents care must be exercised so that use of a particular hydride reducing agent does not present safety problems. Some reducing agents, such as lithium borohydride, decompose at relatively low temperatures and would therefore require processing at relatively low temperature to avoid decomposition.

In accordance with the preferred embodiment of the invention, the hydride reducing agent is present in an aqueous solution containing an effective amount of sodium hydroxide for increasing the stability of the hydride reducing agent.

Hydride reducing agents which are preferred are sodium borohydride, potassium borohydride, and mixtures thereof. The most preferred hydride reducing agent is sodium borohydride. Sodium borohydride is available commercially in powder, pellet and solution form. A preferred solution is an aqueous solution containing 12% by weight sodium borohydride and 41% by weight sodium hydroxide. Such a solution is commercially available from the Ventron Corporation of Beverly, Mass. and is marketed under the trademark "SWS."

The amount of hydride reducing agent to be utilized can be determined by relating the amount of oxidized materials, metals and other components which are removed by treatment with the hydride reducing agent. There is no minimum amount of hydride reducing agent which can be utilized to improve the properties of the used oil, but a minimum amount would be required to react with essentially all of the reactable components that may be present in a given used lubricating oil. Generally, however, the amount of the 12% sodium borohydride/41% sodium hydroxide aqueous solution added to the used lubricating oil is between about 0.05% and 0.25% by volume of the used lubricating oil being treated.

The present invention and its advantages can be more completely understood by reference to the following examples:

EXAMPLE 1

Distillation curves on waste oil utilizing the ANSI/ASTM Method D1160-77 entitled "Standard Method For Distillation of Petroleum Products at Reduced Pressure" with treatment utilizing sodium borohydride and without sodium borohydride were made. The waste oil was pre-distilled to remove fuel components and water.

Treatment with sodium borohydride was accomplished as follows. To 200 milliliters of waste oil was added 0.125% "SWS" solution (12% by weight sodium borohydride and 41% by weight sodium hydroxide obtained from Ventron Corporation) by volume (0.25 milliliters). The oil was placed in a 500 milliliter distillation flask to which had been added a magnetic stir bar. The oil was then distilled at a reduced pressure (10 mmHg) with the oil being stirred constantly.

The following are the results obtained, after correction to 760 mmHg:

| Percent Distilled | Distillation Temperature with no sodium borohydride treatment (degrees Fahrenheit) | Distillation Temperature with sodium borohydride treatment (degrees Fahrenheit) |
|---|---|---|
| Initial boiling point | 517 | 548 |
| 10 | 648 | 671 |
| 20 | 718 | 738 |
| 30 | 767 | 799 |
| 40 | 813 | 844 |
| 50 | 851 | 873 |
| 60 | 887 | 889 |
| 70 | 924 | 936 |
| 80 | 996 | 982 |
| 90 | 1012 | 996 |
| Ending point | 1040 | 1015 |

Thus, the distillation curve was lowered for the used lubricating oil that was treated with sodium borohydride after about 70% of the oil was distilled.

EXAMPLE 2

Used lubricating oil was distilled utilizing two distillation processes, the difference being that one process was without treatment of the used lubricating oil with sodium borohydride, and the other process included treatment by sodium borohydride in the following manner. To 200 milliliters of waste oil was added 0.125% "SWS" solution (12% by weight sodium borohydride and 41% by weight sodium hydroxide obtained from Ventron Corporation) by volume (0.25 milliliters). The oil was placed in a 500 milliliter distillation flask to which had been added a magnetic stir bar. The oil was then distilled at a reduced pressure (10 mmHg) with the oil being stirred constantly.

A 100 SSU viscosity fraction was obtained from each process. The properties of each sample were as follows:

| Property | No sodium borohydride treatment | With sodium borohydride treatment |
|---|---|---|
| Color | 3+ | 1.5 |
| Neutralization number (total acid number) | 0.3 | 0.01 |
| Copper corrosion test | 4a | 1A |
| Metals (ppm) | 135 | 31 |
| Odor | Cracked ($H_2S$) | None |
| Carbonyl absorbance (by infrared analysis) | 0.55 | 0.022 |
| Flash point (degrees F.) | 350 | 365 |

Thus, it can be seen that in the distillation process utilizing sodium borohydride treatment provided a distillate oil having properties which were substantially improved over the oil not treated with the sodium borohydride treatment.

While the invention has been described with respect to preferred embodiments, it is to be understood that the invention is capable of numerous alterations, rearrangements, combinations and other modifications, and those which are within the scope of the appended claims are intended to be covered thereby.

I claim:

1. A method of rerefining used lubricating oil comprising contacting the used lubricating oil with at least one hydride reducing agent selected from the group consisting of sodium borohydride, potassium borohydride, zinc borohydride, sodium cyanoborohydride, sodium sulfurated borohydride, sodium trioxyacetal borohydride, sodium trialkoxy borohydride, sodium hydroxyl borohydride, sodium borohydride anilide, tetrahydrofuran borohydride, di-methyl-butyl borohydride, lithium-aluminum hydride, lithium-aluminum tri-oxymethyl hydride, sodium-aluminum-2-methoxyethoxy hydride, and aluminum hydride.

2. The method as recited in claim 1 wherein the used lubricating oil is maintained at elevated temperature during contact with the hydride reducing agent and below the decomposition temperature of said hydride reducing agent.

3. The method as defined in claim 1 wherein said hydride reducing agent is selected in the group consisting of sodium borohydride, potassium borohydride, and mixtures thereof.

4. The method as recited in claim 3 wherein the used lubricating oil is maintained at elevated temperature during contact with said hydride reducing agent and below the decomposition temperature of said hydride reducing agent.

5. The method as recited in claims 1, 2, 3 or 4 further comprising distillating or evaporating the used lubricating oil, said contacting step being performed before said distillation or evaporation.

6. The method as recited in claims 1, 2, 3 or 4 further comprising distillating or evaporating the used lubricating oil, said contacting step occurring during said distillation or evaporation.

7. The method as recited in claims 1, 2, 3 or 4 further comprising distillating or evaporating the used lubricating oil, said contacting step occurring after said distillation or evaporation.

8. The method as recited in claims 1, 2, 3 or 4 further comprising distillating or evaporating the used lubricating oil, said contacting step occurring before and during said distillation or evaporation.

9. The method as recited in claims 1, 2, 3 or 4 wherein said hydride reducing agent is utilized in an aqueous solution of sodium hydroxide.

10. The method as recited in claim 3 wherein said hydride reducing agent is utilized as an aqueous solution of sodium hydroxide containing about 12% by weight sodium borohydride and about 41% by weight sodium hydroxide, said solution, including said hydride reducing agent, being present in an amount between about 0.05% to about 0.25% by volume of the used lubricating oil.

11. The method as recited in claim 1 wherein said hydride reducing agent is sodium borohydride present in an aqueous solution containing about 12% by weight sodium borohydride and about 41% by weight sodium hydroxide, said aqueous solution being present in an amount of between about 0.05% and 0.25% by volume of the used lubricating oil.

12. A process for distilling or evaporating used lubricating oil comprising introducing an aqueous solution containing sodium hydroxide and a hydride reducing agent selected from the group consisting of sodium borohydride, potassium borohydride, zinc borohydride, sodium cyanoborohydride, sodium sulfurated borohydride, sodium trioxyacetal borohydride, sodium trialkoxy borohydride, sodium hydroxyl borohydride, sodium borohydride anilide, tetrahydrofuran borohydride, di-methyl-butyl borohydride, lithium-aluminum hydride, lithium-aluminum tri-oxymethyl hydride, sodium-aluminum-2-methoxyethoxy hydride, aluminum hydride and mixtures thereof into the used lubricating oil prior to or during distillation or evaporation thereof.

13. The method as recited in claim 12 wherein said hydride reducing agent is sodium borohydride and said aqueous solution contains about 12% by weight sodium borohydride and about 41% by weight sodium hydroxide by weight of said solution.

14. The method as recited in claim 15 wherein said solution is introduced in an amount of between about 0.05 and 0.25 percent by volume of said used oil being treated.

15. The method as recited in claim 12 wherein said hydride reducing agent is selected from the group consisting of sodium borohydride, potassium borohydride and mixtures thereof.

16. A method of increasing the flash point of used lubricating oil comprising contacting the used lubricating oil with an aqueous solution containing at least one hydride reducing agent selected from the group consisting of sodium borohydride, potassium borohydride, zinc borohydride, sodium cyanoborohydride, sodium sulfurated borohydride, sodium trioxyacetal borohydride, sodium trialkoxy borohydride, sodium hydroxyl borohydride, sodium borohydride anilide, tetrahydrofuran borohydride, di-methyl-butyl borohydride, lithium-aluminum hydride, lithium-aluminum trioxymethyl hydride, sodium-aluminum-2-methoxyethoxy hydride and aluminum hydride and thereafter separating the oil from the aqueous solution.

17. A method of reducing at least a portion of the distillation or evaporation temperature curve of used lubricating oil comprising introducing an aqueous solution containing sodium hydroxide and at least one hydride reducing agent selected from the group consisting of sodium borohydride, potassium borohydride, zinc borohydride, sodium cyanoborohydride, sodium sulfurated borohydride, sodium trixoyacetal borohydride, sodium trialkoxy borohydride, sodium hydroxyl borohydride, sodium borohydride anilide, tetrahydrofuran borohydride, di-methyl-butyl borohydride, lithium-aluminum hydride, lithium-aluminum tri-oxymethyl hydride, sodium-aluminum-2-methoxyethoxy hydride and aluminum hydride into the used lubricating oil.

* * * * *

UNITED STATES PATENT AND TRADEMARK OFFICE

CERTIFICATE OF CORRECTION

PATENT NO. : 4,439,311

DATED : March 27, 1984

INVENTOR(S) : Richard H. O'Blasny

It is certified that error appears in the above-identified patent and that said Letters Patent is hereby corrected as shown below:

Column 8, line 1, delete "15" and insert --13--.

Signed and Sealed this

*Twenty-second* Day of *January 1985*

[SEAL]

*Attest:*

DONALD J. QUIGG

*Attesting Officer* *Acting Commissioner of Patents and Trademarks*

REEXAMINATION CERTIFICATE (760th)

United States Patent [19]

O'Blasny

[11] B1 4,439,311

[45] Certificate Issued Sep. 22, 1987

[54] REREFINING USED LUBRICATING OIL WITH HYDRIDE REDUCING AGENTS

[75] Inventor: Richard H. O'Blasny, Natchitoches, La.

[73] Assignee: Delta Central Refining, Inc., Natchitoches, La.

Reexamination Request:
No. 90/001,110, Oct. 6, 1986

Reexamination Certificate for:

| | |
|---|---|
| Patent No.: | **4,439,311** |
| Issued: | **Mar. 27, 1984** |
| Appl. No.: | **336,900** |
| Filed: | **Jan. 4, 1982** |

Certificate of Correction issued Jan. 22, 1985.

[51] Int. Cl.[4] ..... C10G 7/10; C10G 7/00; C10M 11/00

[52] U.S. Cl. ..... 208/179; 208/184; 208/348; 208/251 R

[58] Field of Search ..... 208/179, 184, 251 R, 208/348

[56] References Cited

U.S. PATENT DOCUMENTS 4,252,637 2/1981 Knorre et al. ..... 208/184

FOREIGN PATENT DOCUMENTS 50-122504 9/1975 Japan ..... 208/179
243666 10/1926 United Kingdom ..... 208/179

OTHER PUBLICATIONS

Recycling of Waste Oil, Nat. Oil Rec. Corp. prepared for EPA, Jun. 1975, pp. 73–110.

*The Condensed Chemical Dictionary* 10th ed. Rev. G. G. Halley Van Nostrand Rheinhold Co. New York 1981, pp. 563, 627, 628, 1036.

*Primary Examiner*—John Doll

[57] ABSTRACT

Used lubricating oil is rerefined utilizing hydride reducing agents. The hydride reducing agent contacts the used oil in an aqueous solution, for example. Contact with the hydride reducing agent may occur before, during or after distillation or evaporation of the used lubricating oil. The disclosed method reduces the concentration of carbonyl compounds and metals and reduces the corrosion characteristics of used lubricating oil.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–17 are cancelled.

* * * * *